US006332904B1

(12) United States Patent
Fujiki et al.

(10) Patent No.: US 6,332,904 B1
(45) Date of Patent: Dec. 25, 2001

(54) MIXED POWDER METALLURGY PROCESS

(75) Inventors: Akira Fujiki, Kanagawa-ken; Toshiaki Aoki; Kazuhiro Marumoto, both of Shizuoka-ken; Masaki Yoshida, Hyogo-ken; Hiroyuki Tanaka, Osaka, all of (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/659,833

(22) Filed: Sep. 11, 2000

(30) Foreign Application Priority Data

Sep. 13, 1999 (JP) ..... 11-259359

(51) Int. Cl.[7] ..... C22C 33/05; B22F 3/12

(52) U.S. Cl. ..... 75/243; 75/246; 75/255; 419/11; 419/38

(58) Field of Search ..... 75/243, 246, 255; 419/11, 38

(56) References Cited

U.S. PATENT DOCUMENTS 3,899,319 * 8/1975 Lindskog et al. .
5,108,493 * 4/1992 Causton ..... 75/255
5,605,559 * 2/1997 Unami et al. ..... 75/255
5,976,216 * 11/1999 Samal et al. ..... 75/255
6,068,813 * 5/2000 Semel ..... 419/66
6,214,080 * 4/2001 Narasimhan et al. ..... 75/255

FOREIGN PATENT DOCUMENTS 45-9649 4/1970 (JP) .
56-136901 10/1981 (JP) .
63-103001 5/1988 (JP) .
63-297502 12/1988 (JP) .
4-35010 12/1992 (JP) .
5-295401 11/1993 (JP) .
5-302101 11/1993 (JP) .

* cited by examiner

*Primary Examiner*—Ngoclan Mai
(74) *Attorney, Agent, or Firm*—McDermott, Will & Emery

(57) ABSTRACT

A mixed powder for powder metallurgy process, comprises prealloy type steel mother powder containing alloy components in a range of 1.5 to 4, alloyed micro powder and Ni powder. A preparation method of iron base sintered compact by blending this mixed powder with graphite powder, compressed powder molding the same and sintering at 1050 to 1250° C., and an iron base sintered compact of high tensile strength and fatigue strength obtained by this preparation method.

18 Claims, 11 Drawing Sheets

FIG.1

Table.1

| Sample No. | The sectional circular coefficient of mother powder | Mother steel powder (wt%) | | | | Alloyed micro powder (wt%) | Ni powder (wt%) | Graphite powder (wt%) |
|---|---|---|---|---|---|---|---|---|
| | | Mn | Ni | Cr | Mo | | | |
| 1 | 0.53 | 0.2 | 0.5 | 0 | 1 | 2 | 4 | 0.5 |
| 2 | 0.56 | 0.2 | 0.5 | 0 | 1 | 2 | 4 | 0.5 |
| 3 | 0.60 | 0.2 | 0.5 | 0 | 1 | 2 | 4 | 0.5 |
| 4 | 0.65 | 0.2 | 0.5 | 0 | 1 | 2 | 4 | 0.5 |

FIG.2

Table.2

| Sample No. | Sintered steel composition (wt%) | | | | | | | | | ※ (wt%) | Density of sintered steel (g/cm³) | Tensile strength (kgf/mm²) | Fatigue strength (kgf/mm²) |
|---|---|---|---|---|---|---|---|---|---|---|---|---|---|
| | C | Si | Mn | P | S | Cu | Ni | Cr | Mo | | | | |
| 1 | 0.43 | 0.14 | 0.49 | 0.010 | 0.013 | 0.01 | 5.47 | 0.29 | 1.11 | 20.4 | 7.04 | 110.2 | 29 |
| 2 | 0.46 | 0.14 | 0.48 | 0.012 | 0.011 | 0.02 | 5.41 | 0.30 | 1.14 | 20.4 | 7.04 | 109.3 | 28 |
| 3 | 0.43 | 0.15 | 0.47 | 0.012 | 0.009 | 0.01 | 5.42 | 0.29 | 1.07 | 20.0 | 7.04 | 109.4 | 26 |
| 4 | 0.45 | 0.13 | 0.45 | 0.009 | 0.010 | 0.01 | 5.50 | 0.27 | 1.14 | 20.3 | 7.04 | 108.7 | 26 |

※ 5 [Cr] +5 [Mo] +5 [Mn] +2 [Ni]

FIG.3

Table.3

| Sample No. | Mother steel powder (wt%) | | | | Alloyed micro powder (wt%) | Ni powder (wt%) | Graphite powder (wt%) |
|---|---|---|---|---|---|---|---|
| | Mn | Ni | Cr | Mo | | | |
| 2 | 0.2 | 0.5 | 0 | 1 | 2 | 4 | 0.5 |
| 5 | 0.2 | 0.5 | 0 | 1 | 1.5 | 4 | 0.5 |
| 6 | 0.2 | 0.5 | 0 | 1 | 3 | 4 | 0.5 |
| 7 | 0.2 | 0.5 | 0 | 1 | 3 | 2 | 0.5 |
| 8 | 0.2 | 0.5 | 0 | 1 | 2 | 4 | 0.45 |
| 9 | 0.2 | 0.5 | 0 | 1 | 2 | 4 | 0.6 |
| 10 | 0.2 | 0.5 | 0 | 1 | 2 | 3 | 0.5 |
| 11 | 0.2 | 2 | 0 | 0.5 | 2 | 3 | 0.5 |
| 12 | 0.7 | 0 | 1 | 0.3 | 2 | 4 | 0.5 |
| 13 | 0.2 | 0.5 | 0 | 1 | 4 | 0 | 0.5 |
| 14 | 0.2 | 0.5 | 0 | 1 | 2 | 2 | 0.5 |
| 15 | 0.2 | 0.5 | 0 | 1 | 4 | 2 | 0.5 |
| 16 | 0.2 | 0.5 | 0 | 1 | 0 | 4 | 0.5 |
| 17 | 0.2 | 0.5 | 0 | 1 | 2 | 4 | 0.4 |
| 18 | 0.2 | 0.5 | 0 | 1 | 2 | 4 | 0.7 |
| 19 | 0.2 | 1.5 | 0 | 1 | 2 | 1 | 0.5 |
| 20 | 0.2 | 2 | 0 | 0.5 | 2 | 1 | 0.5 |
| 21 | 0.2 | 2 | 0 | 0.5 | 3 | 3 | 0.5 |

FIG.4

Table.4

| Sample No. | Sintered steel composition (wt%) | | | | | | | | | ※ (wt%) | Density of sintered steel (g/cm³) | Tensile strength (kgf/mm²) | Fatigue strength (kgf/mm²) |
|---|---|---|---|---|---|---|---|---|---|---|---|---|---|
| | C | Si | Mn | P | S | Cu | Ni | Cr | Mo | | | | |
| 2 | 0.46 | 0.14 | 0.48 | 0.012 | 0.011 | 0.02 | 5.41 | 0.30 | 1.14 | 20.4 | 7.04 | 109.3 | 28 |
| 5 | 0.46 | 0.12 | 0.40 | 0.009 | 0.012 | 0.01 | 5.30 | 0.23 | 1.09 | 19.2 | 7.06 | 104.7 | 27 |
| 6 | 0.47 | 0.21 | 0.61 | 0.009 | 0.010 | 0.01 | 6.07 | 0.43 | 1.21 | 23.4 | 7.00 | 106.5 | 27 |
| 7 | 0.44 | 0.21 | 0.63 | 0.013 | 0.009 | 0.01 | 4.12 | 0.40 | 1.19 | 19.3 | 6.90 | 101.1 | 27 |
| 8 | 0.41 | 0.15 | 0.48 | 0.012 | 0.011 | 0.01 | 5.47 | 0.27 | 1.14 | 20.4 | 7.05 | 104.4 | 27 |
| 9 | 0.56 | 0.15 | 0.49 | 0.013 | 0.013 | 0.01 | 5.51 | 0.29 | 1.09 | 20.4 | 7.00 | 100.1 | 28 |
| 10 | 0.44 | 0.13 | 0.46 | 0.011 | 0.010 | 0.02 | 5.41 | 0.27 | 1.10 | 20.0 | 6.83 | 103.2 | 27 |
| 11 | 0.45 | 0.15 | 0.48 | 0.01 | 0.010 | 0.01 | 6.09 | 0.30 | 0.64 | 19.2 | 6.83 | 101.2 | 27 |
| 12 | 0.42 | 0.14 | 1.00 | 0.009 | 0.009 | 0.01 | 5.06 | 1.25 | 0.39 | 23.3 | 6.97 | 111.2 | 30 |
| 13 | 0.43 | 0.26 | 0.75 | 0.012 | 0.011 | 0.01 | 2.70 | 0.57 | 1.28 | 18.4 | 6.93 | 100.7 | 26 |
| 14 | 0.42 | 0.13 | 0.46 | 0.011 | 0.009 | 0.01 | 3.73 | 0.30 | 1.01 | 16.3 | 7.01 | 91.3 | 26 |
| 15 | 0.44 | 0.28 | 0.76 | 0.010 | 0.007 | 0.01 | 4.71 | 0.53 | 1.28 | 22.3 | 6.93 | 112.3 | 24 |
| 16 | 0.44 | 0.01 | 0.19 | 0.013 | 0.009 | 0.01 | 4.47 | 0.01 | 0.98 | 14.8 | 7.10 | 79.3 | 26 |
| 17 | 0.36 | 0.15 | 0.48 | 0.011 | 0.009 | 0.01 | 5.47 | 0.27 | 1.12 | 20.3 | 7.05 | 99.8 | 25 |
| 18 | 0.66 | 0.14 | 0.47 | 0.010 | 0.009 | 0.02 | 5.51 | 0.30 | 1.13 | 20.5 | 7.03 | 89.9 | 26 |
| 19 | 0.44 | 0.14 | 0.50 | 0.010 | 0.012 | 0.01 | 3.66 | 0.28 | 1.14 | 16.9 | 6.91 | 83.8 | 23 |
| 20 | 0.43 | 0.14 | 0.47 | 0.010 | 0.009 | 0.01 | 4.15 | 0.29 | 0.62 | 15.2 | 6.94 | 81.2 | 23 |
| 21 | 0.43 | 0.26 | 0.75 | 0.012 | 0.011 | 0.01 | 6.67 | 0.42 | 0.69 | 22.6 | 6.83 | 105.1 | 25 |

※ 5 [Cr] +5 [Mo] +5 [Mn] +2 [Ni]

FIG.5

Table.5

| Sample No. | Hardness (MHV100g) |
|---|---|
| 2 | 661 |
| 8 | 630 |
| 9 | 692 |
| 13 | 652 |
| 16 | 539 |
| 17 | 581 |
| 18 | 788 |

FIG.6

Table.6

| Sample No. | Mother steel type | Mother stell powder (wt%) | | | | | Alloyed micro powder (wt%) | Ni powder (wt%) | Graphite powder (wt%) | Abrasion loss ($\mu$m) |
|---|---|---|---|---|---|---|---|---|---|---|
| | | Mn | Ni | Cr | Mo | Cu | | | | |
| 2 | Prealloy | 0.2 | 0.5 | — | 1 | — | 2 | 4 | 0.5 | 3 |
| 13 | Prealloy | 0.2 | 0.5 | — | 1 | — | 4 | — | 0.5 | 5 |
| 22 | Diffusion | — | 4 | — | 0.5 | 1.5 | — | — | (0.3) ※Carburized | 16 |

FIG.7

Table.7

| Sample No. | The sectional circular coefficient of mother powder | Mother steel powder (wt%) | | | | Alloyed micro powder (wt%) | Ni powder (wt%) | Graphite powder (wt%) |
|---|---|---|---|---|---|---|---|---|
| | | Mn | Ni | Cr | Mo | | | |
| 23 | 0.56 | — | 0.5 | — | 1 | 2 | 4 | 0.5 |

FIG.8

Table.8

| Sintered steel composition (wt%) | | | | | | | | | ※ (wt%) | Density of sintered steel ($g/cm^3$) | Tensile strength ($kgf/mm^2$) | Fatigue strength ($kgf/mm^2$) | Hardness (MHV100g) |
|---|---|---|---|---|---|---|---|---|---|---|---|---|---|
| C | Si | Mn | P | S | Cu | Ni | Cr | Mo | | | | | |
| 0.44 | 0.01 | 0.47 | 0.011 | 0.013 | 0.29 | 5.46 | 0.29 | 1.17 | 20.57 | 7.02 | 108.7 | 27 | 643 |

※ 5 [Cr] +5 [Mo] +5 [Mn] +2 [Ni]

MIXED POWDER METALLURGY PROCESS

BACKGROUND OF THE INVENTION

1. Field of the Invention

The present inventions relate to a mixed powder for powder metallurgy process, an iron base sintered compact made of the same, and a manufacturing method thereof.

2. Description of the Related Art

Different from conventional manufacturing methods such as rolling, forging or casting, in the powder metallurgy process, metal powder of raw material is processed by compressed powder molding, and then sintered to obtain metal products. High melting point metal material such as W and Mo, porous material such as an oil impregnated bearing and a filter, hard-metal or cermet, or other materials that are hard to obtain by conventional melting methods can be manufactured easily using this powder metallurgy process.

In addition, as the powder metallurgy process does not require cutting, the yield rate is increased, and so the dimensional precision is high. Besides, material segregation or aeolotropy, frequent in the melting process, are rare. Provided with such various advantages, several kinds of materials that have been produced by melting process are gradually manufactured by the powder metallurgy process.

Actually, many of sintered compacts manufactured by powder metallurgy process are automobile parts. Besides, iron base sintering materials are largely used for these sintered compacts. For instance, a sintered material made principally from ion powder, by blending with graphite, copper or other micro powder and sintering to improve strength, weather resistance, wear resistance or the like, is well-known. On the other hand, in order to broaden its application domain, toughness and strength are also required, and for this object, material to which Ni, Mo, or other alloy elements are added is also used.

As representative method to obtain high strength iron base sintered compact by powder metallurgy process, premix process and prealloy method are known as basic method. The premix method consists in, first, blending evenly principal component iron powder with another metal powder to prepare mixed powder, then performing compressed powder molding of the same and, thereafter heating and sintering. This method presents an advantage of relatively easy molding, but added powder in iron powder isolates or segregates in the process before the molding, or added metal powder diffuses itself hardly during the sintering. Therefore, this method brings quality problems such as scattering of strength or dimension of sintered compacts.

On the other hand, the prealloy method consists, first, in preparing alloyed steel powder (prealloy type steel powder) wherein Ni, Mo, Cr or other alloy components are solid solved (alloyed) previously in iron, performing compressed powder molding of the same and, thereafter heating and sintering. As alloyed beforehand, the aforementioned inconvenience of the premix method will not occur. Nevertheless, if the prealloy method is adopted, compression density cannot be increased sufficiently during the compressed powder molding, as alloyed steel powder extremely harder than ordinary iron powder, making difficult to obtain high-density sintered compact. Consequently, it is impossible to make the best use of the properties of the concerned alloyed steel.

SUMMARY OF THE INVENTION

Concerning method to prevent segregation in the premix method, a method for depositing graphite powder on iron and steel powder by means of organic binder is disclosed in the Japanese patent applications laid-open S56-136901 published in 1981 and S63-297502 published in 1988. Moreover, a so-called diffusion deposition method for diffusing and depositing other metal powder or mixed powder on iron powder by heat treatment is disclosed in the Japanese Patent Gazette S45-9649 published in 1970 and the Japanese patent laid-open S63-297502 published in 1988. This diffusion deposition method hardly reduces compressibility and uniforms strength or dimensional precision due to segregation. In other words, for diffusion deposition type mixed steel powder, Ni, Cu, Mo or other single metal powder of their alloyed powder is added to iron powder, blended evenly, and the added powder is diffused and deposited on iron powder surface by diffusion processing, and once diffusion deposited, it never segregates.

Iron base sintered parts are largely used as wear resistant parts requiring abrasion resistance, or high strong parts requiring high strength. Among them, as for of wear resistant parts, FeCr, FeMn, FeMo, WC or other powder is added to mother powder of pure iron powder, diffused type steel powder, prealloy type steel powder to prepare a mixed powder, and then this mixed powder is sintered. Thus obtained sintered compacts are used for automobile engine's valve seat, rocker arm chip, cam or the like. However, these added components deploy only an effect to improve the abrasion resistance, and sintered compacts as sintered can not be the to have a remarkable tensile strength, therefore, quenching/annealing, carburizing quenching/annealing or other thermal treatment is generally applied to improve the strength.

On the other hand, as for high strength material, mixed powder wherein Ni powder or Cu powder is added to JIS (Japanese Industrial Standard) SMF4040 or 5040, diffusion deposition type alloyed steel powder (described below) prealloy type steel powder represented by AISI (American Iron and Steel Institute) 4600 or 4100 are used as raw material powder. However, these raw materials as sintered presents, at most, a tensile strength of 75 kgf/mm, and it is necessary to execute heat treatment after the sintering in order to further increase the tensile strength. In addition, as these sintered compacts without heat treatment present not so good abrasion resistance, heat treatment, especially carburizing quenching/annealing is generally performed after the sintering.

Thus obtained sintered compacts are largely used for automobile transmission parts such as synchronization hubs, cam rings of power steering pump, or the like.

Japanese patent applications laid-open H4-350101 published in 1992, H5-295401 and H5-302101 published in 1993 disclose a technology for obtaining a sintered compact presenting high density, high strength and low dimensional discrepancy during sintering by diffusing conveniently alloy components in iron powder through the adjustment of chemical component composition of added mixed powder, in a mixed powder prepared by adding alloyed powder to iron powder. However, in theses methods, the sintering temperature is relatively high, in general, about 1250 to 1350° C. Moreover, in conventional manufacturing method of iron base sintered compact, heat treatment has been required after the sintering in order to obtain necessary mechanical strength. However, the heat treatment also requires cure work to remove generated heat treatment distortion, increasing inevitably the process cost.

The present invention has been devised to solve the aforementioned problems and has an object to provide iron base sintered compact presenting good tensile strength, fatigue strength, abrasion resistance or other mechanical characteristics, without heat treatment, and mixed powder for preparing such sintered compact by powder metallurgy process.

In order to accomplish the object, a first aspect of the present invention provides a mixed powder for powder metallurgy process characterized by comprising prealloy-type steel mother powder containing 1.5 to 4.5 wt % of alloy component, alloyed micro powder and nickel powder.

According to the first aspect, the combination use of premix method and prealloy method for mixing steel mother powder containing partially alloyed components with alloyed micro powder, and for compressed powder molding using mixed powder, allows to compensate conveniently defects of respective methods, suppress material segregation and improve compressibility. Moreover, by mixing Ni sole powder, this Ni diffuses around steel mother powder, accelerate sintering reaction among particles, and increase strength and toughness of sintered compact. As the result, a sintered compact presenting good mechanical characteristics can be provided without heat treatment after sintering.

A second aspect of the present invention provides a mixed powder for powder metallurgy process characterized by comprising prealloy type steel mother powder containing 1.5 to 4.5 wt % of alloy component and alloyed micro powder, and the sectional circular coefficient Cc of the mother powder is set less than or equal to 0.56. This Cc is expressed by the following formula (1):

$$Cc=4\pi\times S/L^2 \quad (1)$$

Where, S is area, and L is peripheral length.

According to the second aspect, the combination use of premix method and prealloy method allows to compensate conveniently defects of respective methods, suppress material segregation and improve compressibility and, at the same time, the deformed mother powder sectional shape increase the mother powder effective surface area, resulting in long machine life by extension of particle boundary area. As the result, a sintered compact presenting good fatigue strength can be provided without heat treatment after sintering.

Moreover, the manufacturing process of iron base sintered compact of the present invention is characterized by compressing and sintering mixed powder presenting the first aspect or mixed powder presenting the second aspect mentioned above.

The manufacturing method, not requiring heat treatment process after sintering process, allows to reduce the process cost.

Also, the iron base sintered compact of the present invention is characterized by being prepared by means of manufacturing process mentioned above. Sintered compacts presenting good tensile strength and good fatigue strength can be provided without heat treatment after sintering. These sintered compacts are useful for various sprockets of engine, transmission components such as synchronization hub, cam ring or other automobile components.

BRIEF DESCRIPTION OF THE DRAWINGS

FIG. 1 is Table 1 showing mother powder sectional circular coefficient and composition of mixed powder for powder metallurgy process of Example 1;

FIG. 2 is Table 2 showing composition and mechanical characteristics of the sintered compact prepared using the mixed powder for powder metallurgy process shown in Table 1;

FIG. 3 is Table 3 showing the composition of mixed powder for powder metallurgy process of Example 2;

FIG. 4 is Table 4 showing composition and mechanical characteristics of the sintered compact prepared using the mixed powder for powder metallurgy process shown in Table 3;

FIG. 5 is Table 5 showing Vickers hardness of the sintered compact of Example 3;

FIG. 6 is Table 6 showing conditions and abrasion loss amount of using the mixed powder for powder metallurgy process shown in Table 3;

FIG. 7 is Table 7 showing the composition of mixed powder for powder metallurgy process of Example 4;

FIG. 8 is Table 8 showing composition and mechanical characteristics of the sintered compact prepared using conditions shown in Table 4;

DESCRIPTION OF THE PREFERRED EMBODIMENTS

Figure 9:
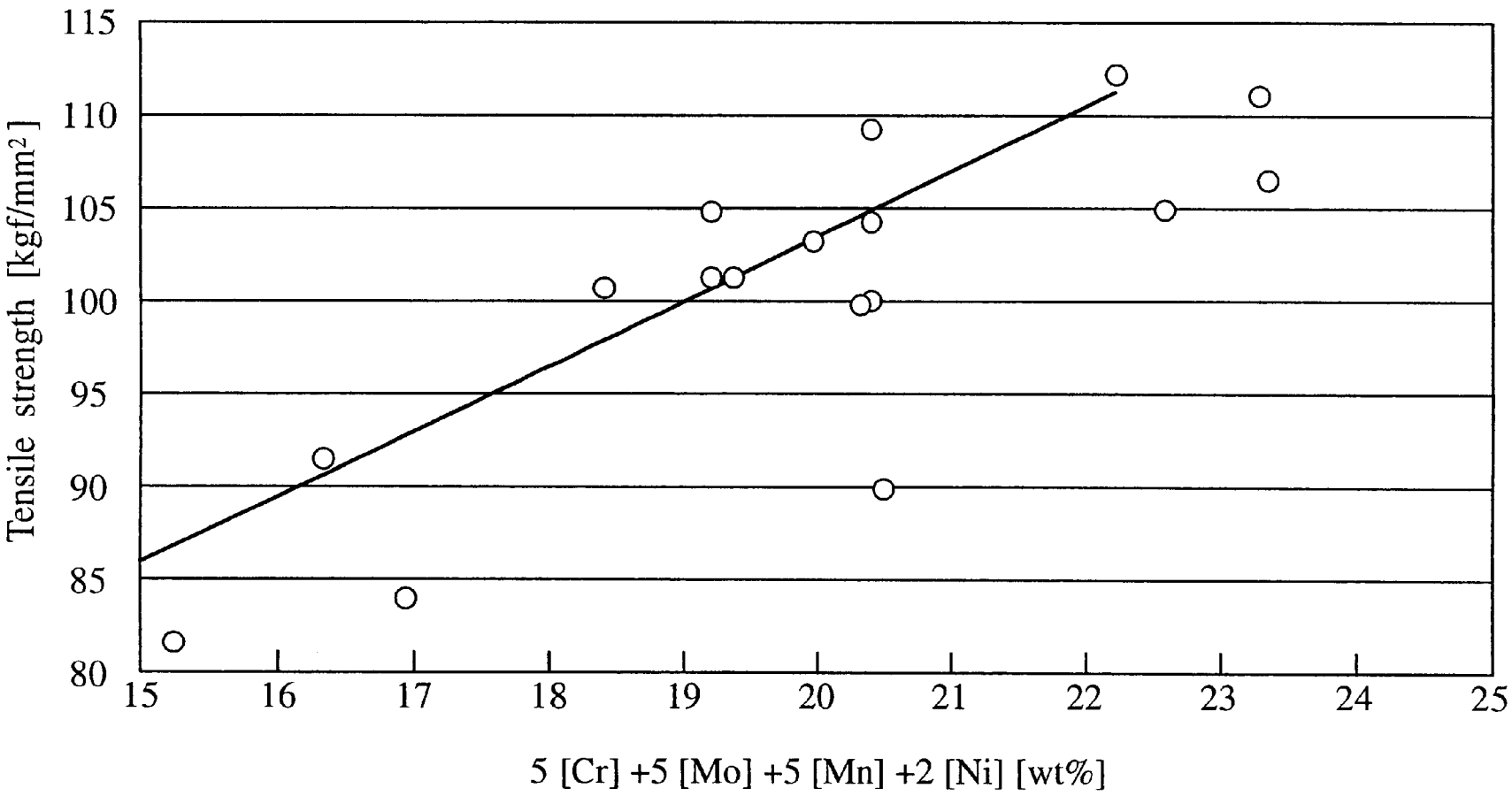
FIG. 9 is a graphic showing the relation between the composition ratio (5[Cr]+5[Mo]+5[Mn]+2[Ni]) in the sintered compact and the tensile strength.

Mixed powder for powder metallurgy process according to an embodiment of the present invention will be described.

The powder for powder metallurgy process of this embodiment is mainly characterized by that prealloy type steel mother powder wherein alloy components are prealloyed within a predetermined amount not to lower the compressibility is used as mother powder, and mixed with alloyed micro powder whose alloy components are prealloyed and Ni powder. The use of this powder can compensate respective defects of conventional premix method and prealloy method. Especially, separate addition of Ni powder from nickel contained in the alloy components allows Ni good diffusion to accelerate grain boundary sintering, and to produce a dense sintered compact.

Another main characteristic of the powder for powder metallurgy process of this embodiment is that the shape of prealloy type steel mother powder is irregular (deformed). The deformed mother powder increases tangling (entwining) among powder particles and effective grain boundary area and, consequently, delays fatigue extending along the grain boundary, increasing fatigue strength.

Now, the powder for powder metallurgy process of this embodiment will be described concretely for each component.

<1.Ni Powder>

First, Ni (nickel) powder added to the mixed powder for powder metallurgy process of this embodiment will be described. As mentioned above, the mixed powder for powder metallurgy process of this embodiment used prealloy type steel powder is used as mother powder and mixed with alloyed micro powder and Ni powder. As mentioned below, Ni is also contained in mother powder or alloyed micro powder, but in the mixed powder of this embodiment, Ni sole powder is added separately.

Separate Ni addition in alloyed component and Ni sole powder allows deploying an effect proper to Ni element powder in addition to effects of alloyed components. Namely, Ni previously added to steel powder as an alloyed component has an effect to improve steel powder hardenability and, at the same time, to increase the toughness.

On the other hand, Ni sole powder has an effect to diffuse on the prealloy type steel powder surface during the sintering and accelerate grain boundary sintering, dense the sintered compact, and improves tensile strength, fatigue strength and toughness of sintered compacts. Shouji also indicates that if Ni powder is added to F powder and the mixed powder is sintered, Ni has an effect to accelerate the sintering by diffusing preferably on Fe powder surface, rather than diffusing into F particle (Keijiro Shouji, "Powder and powder metallurgy", p22, December, 1965).

In order to improve the strength of sintering boundary, it is preferable that Ni powder addition be greater than or equal to 2 wt % of the whole mixed powder; however, too much content will deteriorate the dimensional precision, because Ni powder shrinks in size during the sintering. In addition, it produces residual austenite, lowering strength or abrasion resistance, it is preferable to be less than or equal to 5 wt % or less. Therefore, Ni powder addition is preferably from 2 to 5 wt % of the total mixed powder.

<2. Prealloy Type Steel Powder (Mother Steel Powder)>

Now, prealloy type steel powder used as mother powder will be described. Prealloy type steel powder contains mainly Fe (iron), but also alloyed components in order to improve mechanical characteristics of sintered compact. For this object, the content of alloyed components is preferably greater than or equal to 1.5 wt %. If the content of alloyed components exceeds 4.5 wt %, powder becomes too hard, reducing its compressibility, making difficult to obtain enough density during compressed powder molding process and, moreover, damaging metal molds considerably, and resulting in cost disadvantage. Therefore, the content of alloyed components contained in prealloy type steel powder is preferably from 1.5 to 4.5 wt %.

Here, the particle diameter of prealloy type steel powder is not specially specified and normal diameter, such as about 60 to 100 $\mu$m will be accepted.

(2.1 Shape of Prealloy Type Steel Powder)

One of the characteristics of this embodiment is that the shape of prealloy type steel powder is more irregular than the conventional steel powder. The deformed steel powder increases contact points among powder, further improving bonding power. Moreover, the irregular shape increases steel powder surface area, and enlarges grain boundary area among powder. As the sintered compact's mechanical strength decreases usually along the powder boundary, a large grain boundary area limits the effective deterioration speed and extends machine life. Therefore, the fatigue strength can be improved.

The irregularity of steel powder shape can be evaluated by the sectional circular coefficient (Cc) defined by the following expression (1). This Cc value can be obtained from microscopic image processing of steel powder.

$$\text{Sectional circular coefficient: } Cc=4\pi\times S/L^2 \quad (1)$$

Here, S is area and L is periphery length.

The Cc value is preferably less than or equal to 0.56 to obtain good fatigue strength. To deform the steel powder, it may be reduced in a reducing atmosphere stronger than usual or steel powder may be reduced repeatedly.

(2.2 Alloy Components: Ni, Cr, Mo, Mn)

Alloy components in prealloy type steel powder include, to be specific, Ni, Cr, Mo, Mn or others, known as sintered compact reinforcing elements. At least one or more of these elements may be added from 1.5 to 4.5 wt %; respective addition range of these alloy components and the reason thereof are described below.

Alloyed with Fe, Ni improves the sintered compact hardenability and, at the same time, its toughness, and it is an element essential for improving the sintered compact strength. It may preferably be contained 0.3 wt % or more to deploy these effects. However, as Ni hardens steel powder considerably and thus lowers the compressibility, it is rather preferable to add as a component of alloyed micro powder mentioned below. From the viewpoint of increasing the total Ni quantity (total Ni quantity in mixed powder) as much as possible, the preferable upper limit not to affect the compressibility may be 2.5 wt %. Therefore, the preferable Ni addition range is 0.3 to 2.5 wt %.

Alloyed with Fe, Cr improves the sintered compact hardenability and, at the same time, it's tensile strength and abrasion resistance. Besides, among reinforcing elements, Cr is an element that affects hardly the steel powder compressibility and can be alloyed to some considerable amount. It may preferably be contained 0.3 wt % or more to deploy these effects. However, as Cr can be oxidized easily, too much content in a sintered compact will deteriorate its mechanical characteristics. Therefore, it is preferable to be 3.5 wt % or less. Namely, the preferable Cr addition range is 0.3 to 3.5 wt %.

Similar to Cr, Mo is an element that does not lower the compressibility, and presents an effect to improve the hardenability and increase the strength. Also, Cr is an element that is preferably prealloyed in steel powder, because Mo is easy to reduce during the production of steel powder (mother powder) and slow to diffuse in Fe. Mo may preferably be added by 0.3 wt % or more to deploy these effects; however, as an excessive addition of Mo saturates its improving effect and increasing the cost, it is preferable to limit the addition to 3.5%. Therefore, the preferable Mo addition range is 0.3 to 3.5 wt %.

Mn is an element that deploys an effect to improve the sintered compact hardenability and mechanical characteristics such as tensile strength. It may preferably be contained 0.3 wt % or more to deploy these effects. However, too much content of Mn in steel powder hardens steel powder and deteriorates its compressibility. Moreover, as Mn is hardly reduced, it is difficult to remove oxide film during steel powder production. Therefore, its preferable upper limit of addition may be 3.5 wt %. Namely, the preferable Mn addition range is 0.3 to 3.5 wt %.

(2.3 Inevitable Impurities: O, C, Si )

O (Oxide), C (Carbon), Si (Silicon) or other impurities contaminate into prealloy type steel powder (mother powder). It is necessary to limit content of these impurities in order to obtain prealloy type steel powder of good quality. Now, preferable mixing content of respective impurities will be described below.

First, excessive amount of O impurity is undesirable, as the prealloy type steel powder compressibility decreases. Moreover, as O gasifies in reaction with graphite powder during the sintering, it lowers C addition effectiveness and increases carbon content variation in the sintered compact. Therefore, when O impurity amount is excessive, it is necessary to increase the quantity of graphite powder to be added, resulting in cost increase. From these viewpoints, the content of O impurity is 0.3 wt % or less, and more preferably, 0.15 wt % or less.

Similar to O and N, C is an element invasive to steel and has an effect to harden ferrite. However, when steel powder is submitted to the compression molding, a softer ferrite base can increase compressed powder density; therefore, it is preferable to lower C content in the prealloy type steel powder as much as possible. Moreover, increased compressed powder density improves mold strength and facilitates mold handling. From these viewpoints, the content of C impurity is 0.02 wt % or less.

Si has an effect to improve hardenability, however, as it bonds strongly to O; it produces oxides on the steel powder surface when melted steel is atomized. These oxides are hard to reduce by the reduction process. Moreover, Si has a so great effect to reinforce the ferrite that the steel powder compressibility is affected. From these viewpoints, the content of Si impurity is limited to 0.1 wt % or less.

(2.4 Other Additives: V, Nb, Ti)

Main additives contained in prealloy type steel powder (mother powder) is the aforementioned Ni, Cr, Mo and Mn, however, other additives may also be contained. For example, V (Vanadium), Nb (Niobium), Ti (Titanium) or the like may be contained as necessary. Their preferable addition range and the reason thereof are described below.

V makes crystalline grain fine and improves sintered compact mechanical characteristics. Bonding strongly to carbon, it forms oxides and improves the abrasion resistance. It must be contained 0.01 wt % or more to deploy these effects. However, V bonds strongly to O, therefore, an excessive V addition produces V oxides. V oxides are hard to reduce even by the reduction process. If too much V is alloyed in the steel powder, sintered compact mechanical characteristics are affected unexpectedly. From these viewpoints, the preferable content of V is 1 wt % or less. Namely, when V is to be added, the preferable content of V is 0.1 to 1 wt % or less. Considering refining, more preferable content of V is about 0.2 to 0.5 wt %.

Similarly to V, Nb makes crystalline grain minute and improve sintered compact mechanical characteristics. Bonding strongly to C (carbon), it forms carbides and improves the abrasion resistance. Moreover, it deploys an effect to increase sintered compact dimensional precision. It may preferably be contained 0.01 wt % or more to deploy these effects. However, as Nb bonds strongly to O, it produces much oxide when added excessively, and these oxides are hard to reduce even by the reduction process. These excessive Nb oxides affect sintered compact mechanical characteristics disadvantageously. Moreover, if too much Nb is alloyed in steel powder, it lowers the steel powder compressibility. From these viewpoints, the preferable content of Nb is 0.15 wt % or less. Namely, when Nb is to be added, the preferable content of Nb is 0.01 to 0.15 wt % or less. Considering refining, more preferable content of Nb is about 0.03 to 0.07 wt %.

Similarly to V and Nb, Ti makes crystalline grain minute and improve sintered compact mechanical characteristics. Bonding strongly with C (carbon), it forms carbides and improves the abrasion resistance. Moreover, it deploys an effect to increase sintered compact dimensional precision. It may preferably be contained 0.1 wt % or more to deploy these effects. However, as Ti bonds strongly to O, it produces much oxide when added excessively, and these oxides are hard to reduce even by the reduction process. These excessive Ti oxides affect sintered compact mechanical characteristics disadvantageously. Moreover, if too much Ti is alloyed in steel powder, it lowers the steel powder compressibility. From these viewpoints, the preferable content of Ti is 0.1 wt % or less. Namely, when Ti is to be added, the preferable content of Ti is 0.01 to 0.15 wt % or less. Considering refining, more preferable content of Ti is about 0.02 to 0.05 wt %.

<3. Alloyed Micro Powder>

If a sintered compact is prepared using only prealloy type steel powder, alloying reinforces the structure and increases the tensile strength, but the steel powder compressibility lowers making difficult to obtain a high density. This point is a fatal defect of prealloy type steel powder, because the higher is the density, the better are characteristics, considering sintered compact mechanical characteristics.

In the mixed powder of this embodiment, as prealloy type steel powder containing a predetermined quantity of alloy component is used as mother powder, and mixed with alloyed micro powder whose alloy components are prealloyed. Therefore, the following effects can be expected compared to the case where only prealloy type steel powder is used as raw material powder.

Fist, when only prealloy type steel powder is used, alloy amount is limited, in consideration of compression molding process, however, when alloyed components are added separately as micro powder, it becomes possible to increase alloyed amount in finally obtained sintered compact.

In other words, when alloyed components are added separately as micro powder, the alloyed components' content in the mother powder can be adjusted within a range not to affect the compressibility. Consequently, a good compressibility can be conserved and, as the result, sintered compact density and mechanical characteristics can be improved. This means that, sintered compacts can obtain better mechanical characteristics by using the same molding pressure.

Moreover, in existing prealloy type steel powder, ferrite and venite deposit inevitably in the metal structure, because it is impossible to increase alloy amount considering the compressibility. On the other hand, in the mixed powder of the present invention, the strength can be improved by making sintered compact structure martensite, because alloy component content can be increased.

Also, in this embodiment, it is important that Ni, Cr, Mo, Mn, Si, Cu or other additive elements can be mixed with the aforementioned prealloy type steel powder as previously alloyed powder, instead of independent metal powder. Alloyed beforehand, these elements lower their melting point. This improved diffusion to the prealloy type steel powder and contributes to increase sintered compact strength.

Addition of alloyed micro powder to mother powder allows improving the sintering of whole the steel powder and, also, alloyed components diffusion in the alloyed micro powder increases the sintering boundary strength. It is preferable the alloyed micro powder mixing proportion be 1 wt % or more. It is also preferably be 3 wt % at most, because an excessive mixing proportion deteriorates the molding performances.

Here, alloyed powder particle diameter is not specially specified, and it may be about 15 $\mu$m or less.

(3.1 Alloyed Micro Powder Composition: Ni, Cr, Mo, Mn, Si, Cu)

Main components of alloyed micro powder includes Ni, Cr, Mo, Mn, Si, Cu or others. Respective composition may be set conveniently according to the application of sintered compact; however it is preferable to use Ni from 40 to 70 wt %, Cr 5 to 20 wt %, Mo 5 to 20 wt %, Mn 5 to 20 wt %, Cu 5 to 15 wt % and Cu and/or Si independently or in total 5 to 15 wt %, considering strength, abrasion resistance, or the like. Now, respective composition will be described.

Ni is an element having a good ability to harden the ferrite, and may affect the compressibility. Moreover, as its diffusion speed is relatively high, this element may preferably be added as a component of alloyed micro powder than added to the mother powder as mentioned before. From these viewpoints, it may be contained as much as possible in the alloyed micro powder. Therefore, Ni content in the alloyed micro powder is conveniently about 40 to 70 wt %.

Both Cr and Mo are slow to diffuse and present a low ferrite hardening ability, so they are preferably added to the mother powder as component. However, being alloyed, their diffusion speed can be increased. To deploy these effects, they are preferably contained in alloyed micro powder 5 wt % or more. However, an excessive content decreases the diffusion of alloyed micro powder itself unexpectedly. Therefore, Cr content and Mo content in the alloyed micro powder are preferably 5 to 20 wt % respectively.

Mn is an element having a good ability to harden the ferrite, and this element may preferably be added as a component of alloyed micro powder than added to the mother powder. However, being oxidized easily, Mn cannot be alloyed in quantity in the alloyed micro powder. From these viewpoints, Mn content in the alloyed micro powder is conveniently about 5 to 20 wt %.

Cu and Si are effective to lower the alloyed micro powder melting point by solid dissolution in the alloyed micro powder, and to accelerate diffusion of alloyed micro powder even at a low sintering temperature. To deploy these effects, they are preferably contained 5 wt % or more about independently or in total; however, an excessive content results in melting point elevation unexpectedly, so it is preferable to limit to 15 wt % or less. Still more preferable content of Cu or Si in the alloyed micro powder is 7 to 10 wt % independently or in total.

<4. Composition of Whole Mixed Powder>

Now, alloyed component composition in whole the mixed powder mixing Ni powder, prealloy type steel powder and alloyed micro powder will be described. This alloyed component composition becomes the sintered compact composition.

The alloyed component composition in whole the mixed powder meets preferably expression (2) and (3) below. Namely, it is necessary to satisfy the expression (2) below to obtain a sintered compact tensile strength of 100 kgf/mm$^2$ or more and fatigue strength of 100 kgf/mm$^2$ only by sintering. Moreover, as Ni is an element tending to produce residual austenite, and an excessive total amount not only decreases the strength, but also makes the structure fragile and lowers the abrasion resistance, it may preferably be less than 6.2 wt %.

$$5[Cr]+5[Mo]+5[Mn]+2[Ni]\geqq 19 \text{ wt } \% \quad (2)$$

$$[Ni]<6.2 \text{ wt } \% \quad (3)$$

Here, [Cr], [Mo], [Mn], [Ni] indicate respectively content (wt %) of Cr, Mo, Mn and Ni.

Each element of mixed powder for powder metallurgy process of this embodiment has been described above. This mixed powder can be used both in binder deposition type powder form or diffusion deposition type powder. Independent of adopted form, as the result, they are similar to two-step annealing or other heat treatment only by the following sintering processing, what is preferable from the viewpoint of strength improvement. In other words, the used of mixed powder allows to obtain a sintered compact deploying desired mechanical characteristics, without heat treatment after the sintering.

<5. Preparation of Sintered Compact>

For the preparation of sintered compact, first, graphite powder and zinc stearate, lubricant, are added to and mixed with a mixed powder using the aforementioned prealloy type steel powder, and mixing alloyed micro powder and Ni micro powder. Then, this mixed powder is submitted to compressed powder molding under a pressure about 6 t/cm$^2$. This compressed powder mold is sintered for about 60 min at about 1050 to 1250° C. under a nitrogenous atmosphere containing 10 wt % of hydrogen to complete the sintered compact.

Here, the amount of graphite to be added to the mixed powder is preferably so adjusted that C content in the finally obtained sintered compact be 0.4 to 0.6 wt %. In other words, C solid solutes into the base increasing strength, hardness and abrasion resistance, however, C can not deploy these effects if its content is less than 0.4 wt %, decreasing, for instance, the micro Vickers hardness under 600 HV and sufficient abrasion resistance cannot be obtained. On the other hand, if C content exceeds 0.6 wt %, certainly there is no problem of abrasion resistance, but the strength decreases unexpectedly.

Iron base sintered compact formed using mixed powder for powder metallurgy process of this embodiment presents good mechanical characteristics without performing heat treatment after the sintering, however, obviously, heat treatment may be performed as necessary, to further improve characteristics or the like.

<6. Sintered Compact Applications >

Sintered compacts prepared using mixed powder of this embodiment mentioned above can be applied to various machine components requiring mechanical strength and, especially, to automobile components requiring high tensile strength and high fatigue resistance.

Figure 10A:
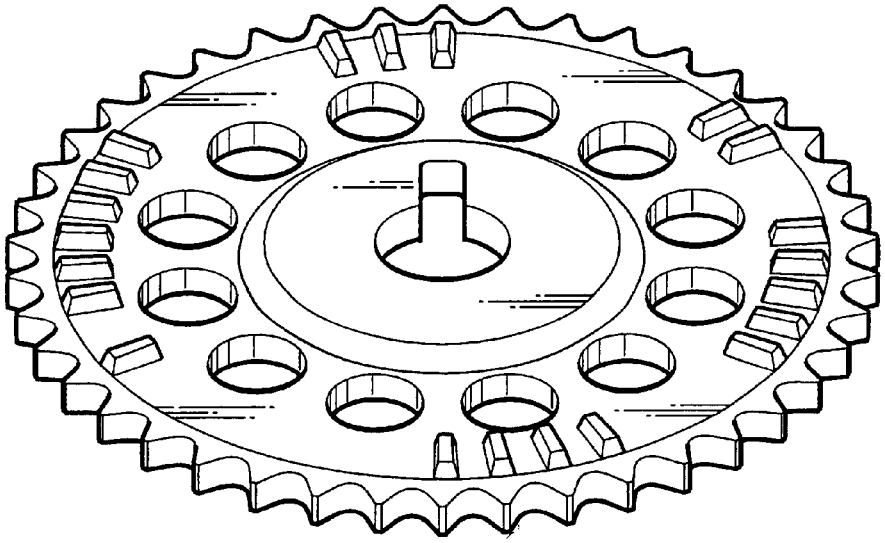
FIGS. 10A to 10C are perspective views of a sprocket, a cam ring, a synchronization hub, examples of automobile components.
Figure 10B:
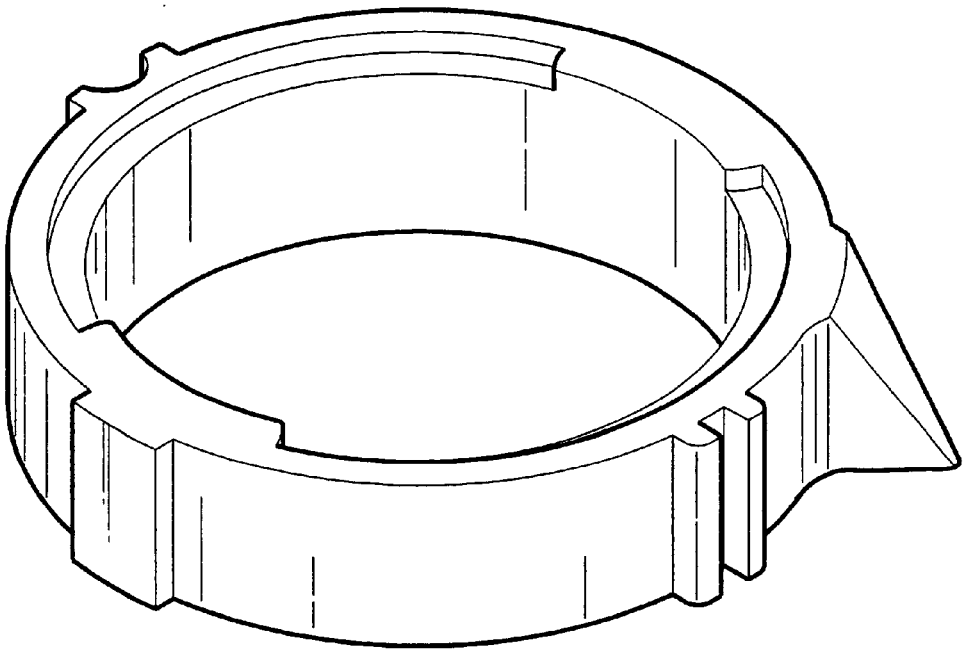
Figure 10C:
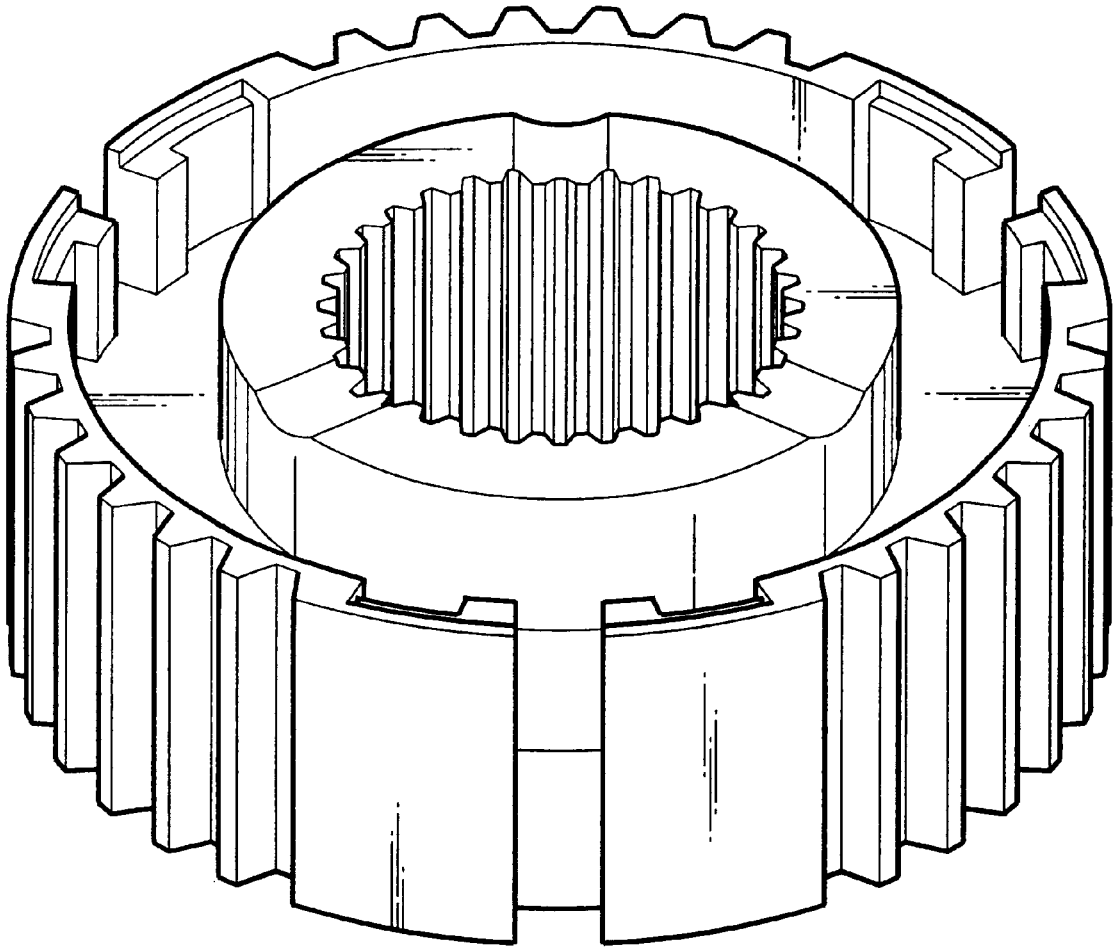

FIGS. 10A to 10C show automobile components appropriate to be manufactured using mixed powder of this embodiment mentioned above. The component shown in FIG. 10A is an engine cam sprocket. Sprocket is a gear component to assure rotation timing of engine crank and camshaft. Besides the sprocket shown in FIG. 10A, sprockets include intake cam sprocket, exhaust cam sprocket, water pump sprocket, crank sprocket, or the like. Any of these sprockets can conveniently manufactured using mixed powder of this embodiment mentioned above.

The component shown in FIG. 10B is a cam ring. Cam ring is a component placed outside the rotor and vane of power steering pump for generating hydraulic pressure with rotor and vane.

The component shown in FIG. 10C is a hub synchronizer (synchronizer hub). It is a component used for synchronizing gears each other during the gear change, in manual transmission.

EXAMPLES

Now, examples realized to confirm the effect of this embodiment will be described.

Example 1

Four kinds of 1 wt % Mo-0.5 wt % Ni prealloy type steel powders different in sectional circular coefficient were prepared as mother powder. 2 wt % of alloyed micro powder (14 wt % Mn-14 wt % Cr-7 wt % Mo-7 wt % Si-the rest Ni), 4 wt % of Ni powder (made by INCO Brand name: INCO287), 0.5 wt % of graphite powder of 0.5 wt % and 0.75 wt % of zinc stearate as lubricant were added to and mixed with this mother powder for 30 min by a mixer. Next, the mixed powder was molded under a pressure of 6 t/cm$^2$ and this compressed powder piece was sintered for 60 min at 1140° C. under a nitrogenous atmosphere containing 10 wt % of hydrogen.

Thus obtained respective sintered compact was worked by machine into JIS 14A type shape tensile test piece and JIS 1 type shape rotation bending fatigue test piece to submit to the tensile test and fatigue test. Sectional circular coefficient (Cc), chemical component composition of used mother powder, additive components and added amount are shown in Table 1, while sintered compact chemical component composition, 5[Cr]+5[Mo]+5[Mn]+2[Ni], sintered compact density, tensile strength and fatigue strength are shown in Table 2.

As obvious from Table 2, the lower is the sectional circular coefficient of mother powder, the better is the fatigue strength. Especially, when the sectional circular coefficient is less than or equal to 0.56, sintered compact shows good value of fatigue strength.

Example 2

Test pieces were prepared under the same conditions as Example 1 using a other powder having a sectional circular coefficient 0.56 or less, and different alloy chemical component composition. Chemical component composition of used mother powder, additive components and added amount are shown in Table 3, while sintered compact chemical component composition, 5[Cr]+5[Mo]+5[Mn]+2[Ni], sintered compact density, tensile strength and fatigue strength are shown in Table 4.

As obvious from these results, tensile strength attained 100 kgf/mm$^2$ or more when the value of 5[Cr]+5[Mo]+5[Mn]+2[Ni] was 19 wt % or more. Sintered compacts No. 17, 18 could not obtain the desired tensile strength because the carbon amount did not meet the range of 0.4 to 0.6 wt %, nor sintered compact No. 14, 19, 20 because the value of 5[Cr]+5[Mo]+5[Mn]+2[Ni] was less than 19 wt %.

Moreover, the fatigue strength of sintered compacts No. 2 and No. 5 to 12 was greater than or equal to 27 kgf/mm$^2$. The desired fatigue strength could not be obtained by sintered compacts No. 13, 16, because they were mixed with alloyed micro powder or Ni powder independently, nor by the sintered compact No. 15, as the added amount of alloyed micro powder exceeded 3 wt %. Moreover, it was found that the desired fatigue strength could not be obtained by sintered compacts No. 21, as Ni content exceeded 6.2 wt %.

Example 3

Next, the martensite structure hardness was measured for the sintered compacts No. 2, 8, 9, 13 and No. 16 to 18. Here, the load of micro Vickers hardness meter was set to 100 g, and the average of 10 measurements was taken as martensite hardness 600 (MHV 100 g). The measurement results are shown in Table 5.

As obvious from Table 5, though the martensite hardness of sintered compacts No. 2, 8, 9 were greater than or equal to 600 (MHV 100 g), it was lower than 600 (MHV 100 g) for the sintered compact No. 16, as the carbon content in the sintered compact was low. As for the sintered compacts No. 13 and 18, though the hardness attained 600 (MHV 100 g), the fatigue strength was lower than 27 kgf/mm$^2$, making them insufficient. This indicates, therefore, that the preferable carbon content range in the sintered compact is 0.4 to 0.6 wt %. On the other hand, the sintered compact No. 16 could not attain the hardness of 600(MHV 100 g), because alloyed micro powder was not blended.

In addition, block-on-ring type abrasion test was performed for the sintered compacts No. 2 and 13. There, to evaluate the abrasion resistance, carburizing material (No. 22) of 4 wt % Ni-1.5 wt % Cu-0.5 wt % Mo diffusion type steel powder was also investigated. The preparation of this carburizing material (No. 22) and Ohgoshi type friction test conditions are as follows. Results are shown in Table 6.

[Preparation Method of Carburizing Material No. 22]

Diffusion type steel powder containing alloy components of 4 wt % Ni, 1.5 wt % Cu and 0.5 wt % Mo was mixed with 0.6 wt % graphite powder and 0.75 wt % zinc stearate as lubricant respectively and sintered for 50 min at 1240° C. under a nitrogenous atmosphere containing 10 wt % hydrogen. Then, it was held for 2 hours at 920° C. in RX gas atmosphere adjusted to carbon potential (C.P.)=1.1 wt %, and then performed carburizing quenching. After quenching, it was annealed at 180° C. for 1 hour.

[Friction Test Method]

Friction test was performed by block-on-ring type friction test machine. Test conditions are as follows, making a block with test material and a ring with control material.

Control material: SCM435H (HRC46 to 49)

Friction speed:5.3 m/sec

Friction distance: 57.000 m

Charge load: 382 N/m

Lubrication method: oil bath method

Lubricant: motor oil (7.5 W-30)

Abrasion loss was 3 $\mu$m for No. 2, 5 $\mu$m for No. 13, and 16 $\mu$m for carburizing quenched No. 22. The abrasion loss of No. 2, corresponding to the conditions of this embodiment was worn less than the other samples.

Example 4

As raw material powder, 1 Mo-0.5 Ni prealloy type steel powder having the sectional circular coefficient 0.56, mother powder, was mixed with additives: 2 wt % of alloyed micro powder (14 wt % Mn-15 wt % Cr-8 wt % Mo-7 wt % Cu-the rest Ni: average grain diameter: 11.4 $\mu$m) and 4 wt % of Ni powder, and then 0.5 wt % of graphite powder and 0.75 wt % of zinc stearate as lubricant were added to and mixed with this mother powder for 30 min by a mixer, before molding under a pressure of 6 t/cm$^2$ and this compressed powder piece was sintered for 60 min at 1140° C. under a nitrogenous atmosphere containing 10 wt % of hydrogen.

After the sintering, it was worked by machine into JIS 14A type shape tensile test piece and JIS 1 type shape rotation bending fatigue test piece to submit to the tensile test and fatigue test and, at the same time, martensite structure hardness was measured. Composition of used powder is shown in Table 7, while sintered compact chemical component composition, sintered compact density, tensile strength, rotation bending fatigue strength and martensite structure hardness are shown in Table 8, respectively.

Good tensile strength, fatigue strength and hardness are shown also in a case where alloyed micro powder contains Cu.

Besides, FIG. 9 shows the relation between the value of "[Cr]+5[Mo]+5[Mn]+[Ni]", alloy components in the sintered compact for the samples of Examples 1 to 4 and the tensile strength. This graphics shows that the preferable value of "[Cr]+5[Mo]+5[Mn]+2[Ni]", alloy components in the sintered compact is greater than or equal to 19 wt % to obtain a good tensile strength of 100 kgf/mm$^2$.

The entire contents of Japanese Patent Application P11-259359 (filed Sep. 13, 1999), are incorporated herein by reference.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A mixed powder for powder metallurgy process, comprising:

prealloy type steel mother powder containing alloy components in a range of 1.5 to 4.5 wt %;

alloyed micro powder; and

Ni powder.

2. A mixed powder for powder metallurgy process, comprising:

prealloy type steel mother powder containing alloy components in a range of 1.5 to 4.5 wt %, the prealloy type steel powder presents the sectional circular coefficient (Cc) represented by the following expression (1) less than or equal to 0.56:

$$Cc=4\pi\times S/L^2 \quad (1)$$

where, S is sectional area and L is peripheral length; and alloyed micro powder.

3. The mixed powder for powder metallurgy process according to claim 1 wherein:

the prealloy type steel mother powder comprises:

Fe as principal component, one or more kinds of alloy component selected from the group consisting of 0.3 to 2.5 wt % Ni, 0.3 to 3.5 wt % Cr, 0.3 to 3.5 wt % Mo and 0.3 to 3.5 wt % Mn;

0.3 wt % or less O impurity;

0.02 wt % or less C impurity; and 0.1 wt % or less Si impurity.

4. The mixed powder for powder metallurgy process according to claim 3, wherein:

the prealloy type steel mother powder further comprises:

one or more kinds of alloy component selected from the group consisting of 0.01 to 1 wt % V, 0.01 to 0.15 wt % Nb and 0.01 to 0.1 wt % Ti.

5. The mixed powder for powder metallurgy process according to claim 1 wherein:

the alloyed micro powder comprises:

alloy components of Ni, Cr, Mo and Mn; and alloy components of Cu and/or Si.

6. The mixed powder for powder metallurgy process according to claim 1 wherein:

the alloyed micro powder comprises:

40 to 70 wt % Ni, 5 to 20 wt % Cr, 5 to 20 wt % Mo and 5 to 20 wt % Mn; and 5 to 15 wt % Cu and/or Si.

7. The mixed powder for powder metallurgy process according to claim 1 wherein:

the proportion of the alloyed micro powder to the mixed powder for powder metallurgy process is 1 to 3 wt %.

8. The mixed powder for powder metallurgy process according to claim 1, wherein:

the proportion of the Ni powder to the mixed powder for powder metallurgy process is 2 to 5 wt %.

9. The mixed powder for powder metallurgy process according to claim 1, wherein:

the chemical component composition of the mixed powder for powder metallurgy process satisfies expression (2) and (3) bellow:

$$5[Cr]+5[Mo]+5[Mn]+2[Ni]\geq 19 \text{ wt } \% \quad (2)$$

$$[Ni]<6.2 \text{ wt } \% \quad (3)$$

where, [Cr], [Mo], [Mn], [Ni] indicate respectively the content (wt %)of Cr, Mo, Mn and Ni.

10. A method of preparing an iron base sintered compact, comprising:

blending mixed powder for powder metallurgy process of claim 1 and graphite powder;

compressed powder molding the powder blended in the previous step; and sintering the compressed powder mold of the previous step.

11. A method of preparing an iron base sintered compact, comprising:

blending mixed powder for powder metallurgy process of claim 2 and graphite powder;

compressed powder molding the powder blended in the previous step; and sintering the compressed powder mold of the previous step.

12. The method of preparing an iron base sintered compact according to claim 10, wherein:

the sintered temperature is 1050 to 1250° C.

13. An iron base sintered compact, prepared by the preparation method of the claim 10.

14. An iron base sintered compact, prepared by the preparation method of the claim 11.

15. The iron base sintered compact according to claim 13, wherein:

carbon content is 0.4 to 0.6 wt % and micro Vickers hardness is greater than or equal to 600.

16. The iron base sintered compact according to claim 15, wherein:

the sintered compact is a sprocket of automobile engine.

17. The iron base sintered compact according to claim 15, wherein:

the sintered compact is hub synchronizer of automobile transmission.

18. The iron base sintered compact according to claim 15, wherein:

the sintered compact is a cam ring of automobile.

* * * * *